United States Patent [19]

Matsuoka et al.

[11] Patent Number: 4,534,801

[45] Date of Patent: Aug. 13, 1985

[54] PROCESS FOR REMOVING ADHERED SUBSTANCE FROM STEEL INGOTS

[75] Inventors: Shigeki Matsuoka; Yoshihiro Naitoh, both of Tokai, Japan

[73] Assignee: Daido Steel Company Limited, Japan

[21] Appl. No.: 467,523

[22] Filed: Feb. 17, 1983

[30] Foreign Application Priority Data

Feb. 19, 1982 [JP] Japan ..... 57-24294

[51] Int. Cl.[3] ..... B08B 7/00

[52] U.S. Cl. ..... 134/15; 134/17; 134/19; 164/76.1; 164/128; 164/477; 164/486

[58] Field of Search ..... 164/477, 76.1, 486, 164/128; 134/17, 15, 19

[56] References Cited

U.S. PATENT DOCUMENTS

| | | | |
|---|---|---|---|
| 1,898,809 | 2/1933 | Berg | 134/17 X |
| 2,394,514 | 2/1946 | Evans et al. | 134/17 X |
| 2,425,134 | 8/1947 | Strickland, Jr. | 134/17 X |
| 3,486,938 | 12/1969 | Dubitsky | 164/76.1 X |
| 3,928,090 | 12/1975 | Randerson | 148/143 X |
| 4,043,166 | 8/1977 | Leroy | 134/15 X |

FOREIGN PATENT DOCUMENTS

| | | | |
|---|---|---|---|
| 562379 | 9/1977 | U.S.S.R. | 164/76.1 |

*Primary Examiner*—Nicholas P. Godici
*Assistant Examiner*—J. Reed Batten, Jr.
*Attorney, Agent, or Firm*—Sughrue, Mion, Zinn, Macpeak, and Seas

[57] ABSTRACT

A process for removing an adhered substance from steel ingots, which comprises heating or cooling a steel ingot after the casting under such conditions that the heating or cooling rate at the surface layer portion of the steel ingot is not less than 2° C./sec and the temperature difference between the starting and end points is not less than 300° C.

8 Claims, No Drawings

PROCESS FOR REMOVING ADHERED SUBSTANCE FROM STEEL INGOTS

BACKGROUND OF THE INVENTION

1. Field of the Invention

The present invention relates to a process for removing an adhered substance from steel ingots.

2. Description of the Prior Art

In general, adhered substances resulting from factors such as hot top flame, refractorys, oxide film inhibitor, flux, lagging board and the like associated with the casting process are often strongly adhered to the surface of steel ingots produced by using an ingot mold, cast slab produced by continuous casting.

In the blooming of the steel ingot or slab having such an adhered substance, when the steel ingot is heated in a soaking furnace (or a heating furnace), not only is the possibility reduced for removing a harmful surface portion by the scale loss in the heating, but also the adhered substance is forced into steel products by rolls at a subsequent rolling stage, which results in surface defects of the steel products.

Therefore, it is desired to remove the adhered substance from the steel ingot at a stage before the placing of the steel ingot in the soaking furnace (or the heating furnace).

However, the removal of the adhered substance is fairy difficult in the prior art and hence it is very difficult to improve the surface quality of the steel products owing to the unsatisfactory removal of the adhered substance.

SUMMARY OF THE INVENTION

It is an object of the present invention to solve the above mentioned drawbacks of the prior art and to provide a process for removing an adhered substance from steel ingots which can effectively remove the adhered substance resulting from the casting process and strongly adhered to the surface of the steel ingots after the casting and can attain reduction of inferior steel products due to surface defects and decrease of step number by surface improvement and the like.

According to the present invention, there is the provision of a process for removing an adhered substance from steel ingots comprising heating or cooling a steel ingot, after the casting under such a condition that a heating or cooling rate at a surface layer portion of the steel ingot is not less than 2° C./sec and a temperature difference between the starting and end points of the heating or cooling process is not less than 300° C., whereby adhered substance resulting from the casting process is removed from the surface of the steel ingot.

DESCRIPTION OF THE PREFERRED EMBODIMENT

According to the present invention, steel ingots include a ingot produced by using an ingot mold, a cast slab produced by continuous casting and the like. The ingot mold includes conventionally known ones for bottom or direct pourings, while the continuous casting includes a continuous-continuous casting.

Further, use is made of conventionally known molding additives and associated factors such as hot top flame, refractorys, oxide film inhibitor, flux, lagging board and the like. As the molding additives, use is concretely made of mixtures of oxides such as $SiO_2$, $Al_2O_3$, CaO, FeO, MnO, $Cr_2O_3$, MgO, $Na_2O$, $K_2O$ and the like and elements such as C, Fe, Al and the like in an optional mixing ratio.

According to the present invention, the reason why the heating or cooling rate at the surface layer portion of the steel ingot after the casting is not less than 2° C./sec and the temperature difference is not less than 300° C. is due to the fact that heat expansion or heat shrinkage is produced between the adhered substance and the steel ingot by the heating or cooling in a short time and shock accompanied therewith peels off the adhered substance from the surface of the steel ingot or transformation of the adhered substance is produced according to the chemical composition of that adhered substance and hence the adhered substance is peeled off from the surface of the steel ingot due to expansion or shrinkage based on such transformation. But when the heating or cooling rate is less than 2° C./sec and the temperature difference between the starting and end points is less than 300° C., the effect of removing the adhered substance is reduced.

As the heating means for the removal of the adhered substance, use may be made of electric resistance heating, high frequency induction heating and the like. As the cooling means for the removal of the adhered substance, use may be made of a method wherein the steel ingot is dipped into a water tank, a method wherein high pressure water is jetted onto the steel ingot, and the like. According to the jetting of high pressure water, the effect of promoting the peel-off of the adhered substance is high when cracks are produced in the adhered substance.

The following examples are given in illustration of this invention and are not intended as limitations thereof.

EXAMPLE 1

Molten steel of SAE 8620 was poured into an ingot mold by direct pouring to form an ingot. In this case, a heat-insulating board ($SiO_2$:60%, $Al_2O_3$:7%, CaO:8%, C:17%) was used as a hot top flame and a flux (C:18%, $SiO_2$:39%, $Al_2O_3$:13%, CaO:8%) and a lagging board (C:14%, FeO:13%, $SiO_2$:4%, $Al_2O_3$:40%, metallic Al:24%) were used as an oxide film inhibitor. Then, the resulting steel ingot was heated by electric resistance heating means from a temperature before heating as shown in the following Table 1 to a temperature after heating as shown in Table 1 and further heated for blooming and bloomed to produce a steel products. Thereafter, surface defects were inspected with respect to the steel products to examine inferior products resulted from adhered substance. The measured results are also shown in Table 1. Moreover, the temperature of steel ingot was measured by means of a radiation thermometer (DS-06 type, made by Daido Steel Co., Ltd.). In Table 1, O represents a good product and X represents an inferior product.

TABLE 1

| Temperature before heating (°C.) | Temperature after heating (°C.) | Temperature difference (°C.) | Heating time (sec) | Heating rate (°C./sec) | Products |
|---|---|---|---|---|---|
| 830 | 1250 | 420 | 170 | 2.5 | O |
| 800 | 1210 | 410 | 80 | 5.1 | O |
| 750 | 1120 | 370 | 70 | 5.3 | O |
| 630 | 940 | 310 | 70 | 4.4 | O |
| 480 | 950 | 470 | 70 | 6.7 | O |
| Room | 650 | 630 | 60 | 10.5 | O |

TABLE 1-continued

| Temperature before heating (°C.) | Temperature after heating (°C.) | Temperature difference (°C.) | Heating time (sec) | Heating rate (°C./sec) | Products |
|---|---|---|---|---|---|
| temperature (20) | | | | | |
| Room temperature (20) | 500 | 470 | 190 | 2.5 | O |
| 750 | 1000 | 250 | 80 | 3.1 | X |
| 700 | 1100 | 400 | 220 | 1.8 | X |
| Room temperature (20) | 270 | 250 | 170 | 1.5 | X |
| Room temperature (20) | 350 | 330 | 220 | 1.5 | X |

As apparent from Table 1, good results can be obtained when the heating rate is not less than 2° C./sec and the temperature difference is not less than 300° C.

EXAMPLE 2

Molten steel of JIS SCR 420 was poured into an ingot mold by direct pouring to form a steel ingot. In this case, a heat-insulating board ($SiO_2$:60%, $Al_2O_3$:7%, CaO:8%, C:17%) was used as a hot top flame and also flux (C:18%, $SiO_2$:39%, $Al_2O_3$:13%, CaO:8%) and a lagging board (C:14%, FeO:13%, $SiO_2$:4%, $Al_2O_3$:40%, metallic Al:24%) were used as an oxide film inhibitor. Then, the resulting steel ingot was water-cooled from a temperature before cooling as shown in the following Table 2 to a temperature after cooling as shown in Table 2 for a cooling time as shown in Table 2 and heated for blooming and bloomed to produce a steel product. Thereafter, surface defects were inspected with respect to the steel products to examine inferior products resulting from the adhered substance. The measured results are also shown in Table 2.

TABLE 2

| Temperature before cooling (°C.) | Temperature after cooling (°C.) | Temperature difference (°C.) | Cooling time sec | Cooling rate (°C./sec) | Products |
|---|---|---|---|---|---|
| 850 | 550 | 300 | 20 | 15 | O |
| 870 | 150 | 720 | 290 | 2.5 | O |
| 870 | 460 | 410 | 35 | 11.7 | O |
| 830 | 170 | 660 | 160 | 4.1 | O |
| 900 | 350 | 550 | 100 | 5.5 | O |
| 750 | 220 | 530 | 65 | 8.2 | O |
| 700 | 380 | 320 | 30 | 10.7 | O |
| 730 | 250 | 480 | 75 | 6.4 | O |
| 860 | 610 | 250 | 70 | 3.6 | X |
| 910 | 810 | 100 | 20 | 5.0 | X |
| 850 | 450 | 400 | 250 | 1.6 | X |
| 700 | 550 | 150 | 70 | 2.1 | X |
| 710 | 490 | 220 | 60 | 3.7 | X |
| 850 | 500 | 350 | 230 | 1.5 | X |

As apparent from Table 2, good results can be obtained when the cooling rate is not less than 2° C./sec and the temperature difference is not less than 300° C.

EXAMPLE 3

Molten steel of JIS SCR 420 was cast by continuous casting to form a cast slab. In this case, a flux (CaO:40%, $SiO_2$:50%, C:7%) was used. Then, the resulting cast slab was heated or cooled under the same conditions as described in Example 1 or 2 and then heated for blooming and bloomed to produce a steel product. Thereafter, surface defects were inspected with respect to the steel products to determine if any inferior products resulted from the adhered substance. The measured results are shown in the following Tables 3 and 4.

TABLE 3

| Temperature before heating (°C.) | Temperature after heating (°C.) | Temperature difference (°C.) | Heating time (sec) | Heating rate (°C./sec) | Products |
|---|---|---|---|---|---|
| 840 | 1150 | 310 | 130 | 2.4 | O |
| 740 | 1120 | 380 | 45 | 8.4 | O |
| 400 | 880 | 480 | 150 | 3.2 | O |
| 230 | 750 | 520 | 50 | 10.4 | O |
| 850 | 1060 | 210 | 50 | 4.2 | X |
| 200 | 650 | 450 | 350 | 1.3 | X |

TABLE 4

| Temperature before cooling (°C.) | Temperature after cooling (°C.) | Temperature difference (°C.) | Cooling time (sec) | Cooling rate (°C./sec) | Products |
|---|---|---|---|---|---|
| 920 | 570 | 350 | 25 | 14 | O |
| 750 | 210 | 540 | 190 | 2.8 | O |
| 850 | 230 | 620 | 55 | 11.3 | O |
| 860 | 540 | 320 | 60 | 5.3 | O |
| 950 | 710 | 240 | 35 | 6.9 | X |
| 730 | 350 | 380 | 250 | 1.5 | X |

According to the present invention, as mentioned above, the steel ingots produced by using molding additives such as hot top flame, refractorys, oxide film inhibitor, flux, lagging board and the like are heated or cooled under such a condition that the heating or cooling rate at the surface layer portion of the steel ingots after the casting is not less than 2° C./sec and the temperature difference is not less than 300° C., whereby the adhered substance made from the molding additives on the surface of the steel ingots can effectively be removed. As a result, it is possible to considerably reduce the surface defect of the steel products after the blooming of the steel ingots, whereby the surface quality of steel products can be improved.

What is claimed is:

1. A process for removing an adhered substance from a steel ingot formed by a casting process using molding additives comprising heating said steel ingot subsequent to the casting process with a heating rate at the surface layer portion of the steel ingot being not less than 2° C./second to provide a temperature difference between the starting point and the end point of the heating which is not less than 300° C. whereby said adhered substance caused by said molding additives is removed from the surface of said steel ingot.

2. The process according to claim 1 wherein said heating is performed by electrical resistance heating means.

3. The process according to claim 1 wherein said heating is performed by high frequency induction heating means.

4. A process according to claim 1 wherein said steel ingot is produced by casting steel into an ingot mold.

5. A process according to claim 1 wherein said steel ingot is produced by a continuous casting of steel.

6. A process for removing an adhered substance from a steel ingot formed by a casting process using molding additives comprising cooling said steel ingot subsequent to said casting process with a cooling rate at the surface layer portion of said steel ingot being not less than 2° C./second to provide a temperature difference between the starting point and the end point of the cooling which is not less than 300° C. whereby said adhered substance caused by said molding additives is removed from the surface of said steel ingot.

7. A process according to claim 6 wherein said cooling is performed by dipping said steel ingot into a water tank.

8. A process according to claim 6 wherein said cooling is performed by jetting high pressure water onto said steel ingot.

* * * * *